US005413042A

United States Patent [19]

Weiss et al.

[11] Patent Number: 5,413,042

[45] Date of Patent: May 9, 1995

[54] LOCK-UP ASSEMBLY FOR SECURING A PRINTING PLATE ON A PLATE CYLINDER

[75] Inventors: Gregory W. Weiss, Barrington, N.H.; John M. Gaffney, Kittery Point, Me.; John J. Dowling, Somersworth, N.H.

[73] Assignee: Heidelberg Druckmaschinen AG, Heidelberg, Germany

[21] Appl. No.: 199,618

[22] Filed: Feb. 22, 1994

[51] Int. Cl.[6] ..... B41F 27/06; B41F 27/12

[52] U.S. Cl. ..... 101/415.1; 101/382.1; 101/383; 101/378; 101/411

[58] Field of Search ..... 101/378, 382.1, 383, 101/409, 410, 411, 415.1

[56] References Cited

U.S. PATENT DOCUMENTS

| | | | |
|---|---|---|---|
| 3,335,663 | 8/1967 | Harenza . | |
| 3,410,211 | 11/1968 | Grunig . | |
| 3,727,551 | 4/1973 | Kostas et al. . | |
| 4,223,604 | 9/1980 | Brehm et al. | 101/415.1 |
| 4,641,576 | 2/1987 | Güthling et al. | 101/415.1 |
| 4,862,801 | 9/1989 | Marmin | 101/415.1 |
| 4,893,561 | 1/1990 | Grosshauser et al. | 101/382.1 |
| 5,123,353 | 6/1992 | Beck | 101/415.1 |
| 5,359,933 | 11/1994 | Blaser et al. | 101/415.1 |

*Primary Examiner*—Edgar S. Burr
*Assistant Examiner*—Lynn D. Hendrickson
*Attorney, Agent, or Firm*—Tarolli, Sundheim & Covell

[57] ABSTRACT

A lock-up assembly (20) for securing a printing plate (22) on a plate cylinder (10) includes a rotatable lock bar (32) and a spring biased linkage mechanism (36). The linkage mechanism (36) has a first over-center condition in which it rotates the lock bar (32) toward a locked position, and has a second over-center condition in which it rotates the lock bar (32) toward an unlocked position. A movable blocking member (82) blocks the linkage mechanism (36) from switching to the second over-center condition under the influence of centrifugal force when the cylinder (10) is rotating during a printing operation. A hand held tool (40) engages the linkage mechanism (36) to switch it between the first and second over-center conditions upon manual manipulation of the tool (40). The tool (40) also engages the blocking member (82) to move the blocking member (82) from the first position to the second position when the tool (40) is moved into engagement with the linkage mechanism (36).

12 Claims, 3 Drawing Sheets

LOCK-UP ASSEMBLY FOR SECURING A PRINTING PLATE ON A PLATE CYLINDER

FIELD OF THE INVENTION

The present invention relates to a plate cylinder which supports a printing plate in a printing unit, and particularly relates to a lock-up assembly for securing the printing plate on the plate cylinder.

BACKGROUND OF THE INVENTION

A printing plate has a surface which defines an image to be printed. The printing plate is mounted on a rotatable plate cylinder in a printing unit. Ink is applied to the printing plate on the plate cylinder, and the inked image is transferred to paper or other material when the cylinder rotates in the printing unit.

The printing plate is formed as a thin sheet of metal, and is mounted on the plate cylinder by wrapping the sheet around the cylindrical outer surface of the cylinder. When the plate is thus mounted on the cylinder, opposite edge portions of the plate extend axially along the cylinder. A lock-up assembly within the cylinder engages the opposite edge portions of the plate to hold the plate securely on the cylinder when the cylinder rotates.

SUMMARY OF THE INVENTION

In accordance with the present invention, a lock-up assembly for securing a printing plate on a plate cylinder comprises a rotatable lock bar and a linkage mechanism. The lock bar secures the printing plate on the cylinder upon rotation of the lock bar in a first direction, and releases the printing plate for removal from the cylinder upon rotation of the lock bar in a second direction. A coil spring provides a spring force for rotating the lock bar. The linkage mechanism rotates the lock bar under the influence of the spring force. The linkage mechanism has a first over-center condition in which it rotates the lock bar in the first direction, and has a second over-center condition in which it rotates the lock bar in the second direction.

The lock-up assembly further comprises a movable blocking member and a hand held tool. The blocking member has a first position in which it blocks the linkage mechanism from switching to the second over-center condition, and has a second position in which it does not block the linkage mechanism from switching to the second over-center condition. The hand held tool engages the linkage mechanism to switch it between the first and second over-center conditions upon manual manipulation of the tool. The tool also engages the blocking member to move the blocking member from the first position to the second position upon manual manipulation of the tool.

In a preferred embodiment of the present invention, the linkage mechanism includes a toggle link, and is subjected to a centrifugal force which urges it to switch from the first over-center condition to the second over-center condition when the plate cylinder rotates during a printing operation. The blocking member is one of a pair of spring tabs which are located in the path of movement of the toggle link. The spring tabs block movement of the toggle link during a printing operation, and thus prevent the linkage mechanism from switching to the second over-center condition under the influence of the centrifugal force. As a result, the spring tabs prevent the lock bar from rotating out of the locked position under the influence of the centrifugal force. The hand held tool moves the spring tabs out of the path of movement of the toggle link when the tool is moved into engagement with the linkage mechanism to switch the linkage mechanism into the second over-center condition. When the tool is subsequently disengaged from the linkage mechanism, the spring tabs flex resiliently back to the positions in which they block movement of the toggle link.

BRIEF DESCRIPTION OF THE DRAWINGS

Further features of the present invention will become apparent to those skilled in the art to which the present invention relates from reading the following description with reference to the accompanying drawings, in which.

DESCRIPTION OF A PREFERRED EMBODIMENT

Figure 1:
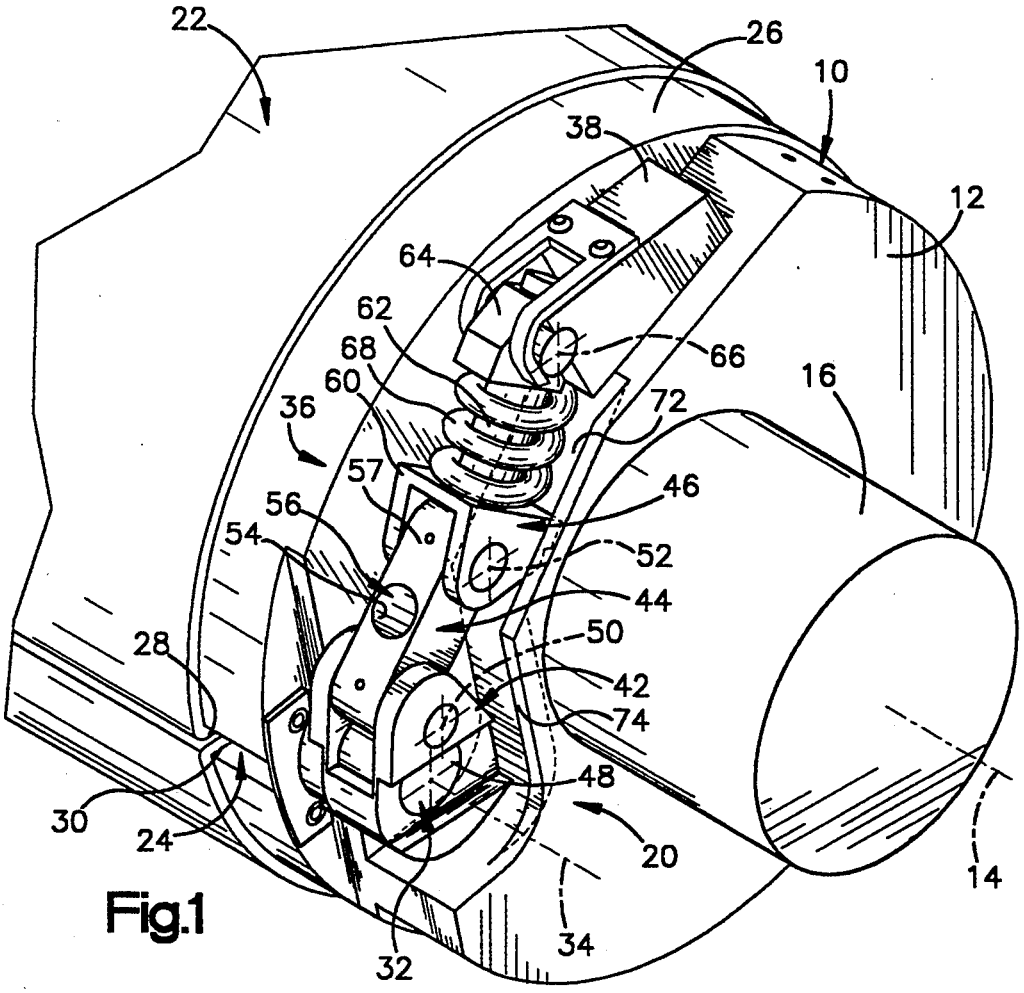
FIG. 1 is a view of parts of an apparatus constructed in accordance with the present invention, including a plate cylinder.

A plate cylinder 10 constructed in accordance with the present invention is shown in FIG. 1. The plate cylinder 10 has a cylindrical body 12 with a longitudinal central axis 14. Each end of the plate cylinder 10 has a stub shaft 16, one of which is shown in FIG. 1. The stub shafts 16 are receivable in bearings to support the plate cylinder 10 for rotation about the axis 14 in a printing unit in a known manner. The plate cylinder 10 further has a lock-up assembly 20 which holds a printing plate 22 securely on the cylinder body 12.

A slot 24 extends axially along the cylindrical outer surface 26 of the cylinder body 12. The printing plate 22 is wrapped around the cylindrical outer surface 26, and has opposite edge portions 28 and 30 which extend into the slot 24. The edge portion 30 of the plate 22 is hooked around an edge of the cylinder body 12 at the slot 24 so as to be held in the slot 24 in a known manner. The lock-up assembly 20 releasably holds the other edge portion 28 of the plate 22 in the slot 24, and thus holds the plate 22 releasably on the cylindrical outer surface 26.

The lock-up assembly 20 includes an elongated lock bar 32 which extends axially through the cylinder body 12 at a location radially inward of the slot 24. The lock bar 32 engages the edge portion 28 of the plate 22 within the slot 24 in a known manner, and is supported for rotation about its longitudinal central axis 34 relative to the cylinder body 12. The lock bar 32 is thus rotatable between a locked position, in which it secures the edge portion 28 of the plate 22 in the slot 24, and an unlocked position, in which it releases the edge portion 28 of the plate 22 for removal from the slot 24.

Figure 7:
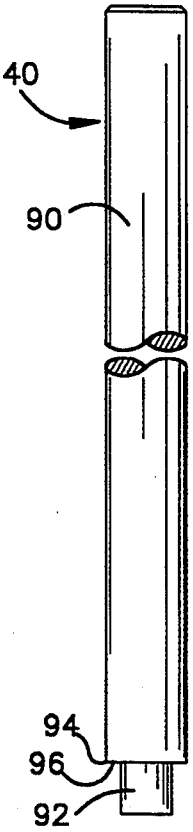
FIG. 7 is a view of a part shown in FIGS. 4 and 5.

The lock-up assembly 20 further includes a linkage mechanism 36 which extends between the lock bar 32 and a block 38 that is fixed to the cylinder body 12. The linkage mechanism 36 controls rotation of the lock bar 32 between the locked position and the unlocked position, and is operated manually by use of a hand held tool 40 (FIG. 7).

The linkage mechanism 36 includes a lever 42, a toggle link 44, and a sliding link 46. The lever 42 is mounted on an end portion 48 of the lock bar 32 so as to rotate with the lock bar 32 about the axis 34. The toggle link 44 connects the lever 42 with the sliding link 46, and is pivotal relative to the lever 42 and the sliding link 46 about first and second linkage axes 50 and 52, respectively. A cylindrical inner surface 54 of the toggle link 44 defines a bore 56 extending between the radially inner and outer side surfaces 57 and 58 of the toggle link 44.

A hub portion 60 of the sliding link 46 is connected to the toggle link 44 for pivotal movement relative to the toggle link 44 about the second linkage axis 52. A shaft portion 62 of the sliding link 46 extends through, and is movable longitudinally in, a nut 64. The nut 64 is supported on the block 38 for pivotal movement about a third linkage axis 66.

A coil spring 68 acts between the nut 64 and the hub portion 60 of the sliding link 46. The coil spring 68 urges the sliding link 46 to move longitudinally through the nut 64 in a direction away from the block 38, and permits the sliding link 46 to move longitudinally through the nut 64 in the opposite direction toward the block 38 against the bias of the coil spring 68.

Figure 2:
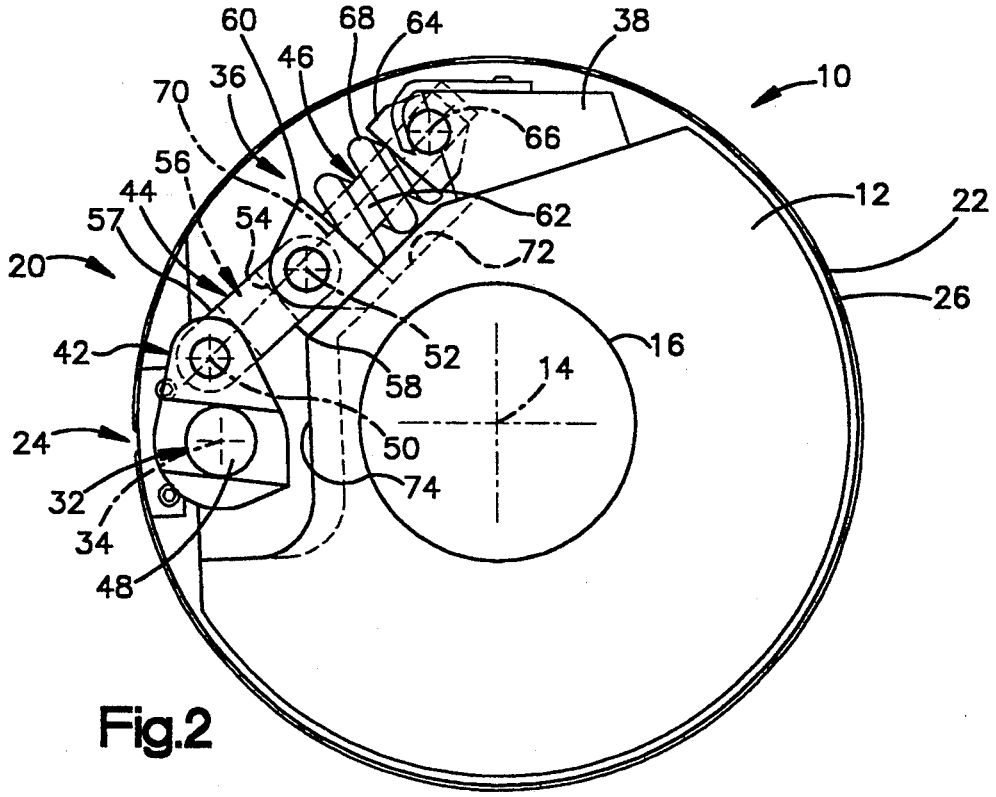
FIG. 2 is an end view of the plate cylinder of FIG. 1.

The linkage mechanism 36 has a first over-center condition and a second over-center condition. When the linkage mechanism 36 is in the first over-center condition, as shown in FIG. 2, the second linkage axis 52 is located radially inward of a line 70 extending between the first linkage axis 50 and the third linkage axis 66. The sliding link 46 then forces the toggle link 44 to pivot about the second linkage axis 52 in the clockwise direction, and also to pivot about the first linkage axis 50 in the clockwise direction, under the force of the coil spring 68. The toggle link 44 in turn transmits the force of the coil spring 68 to the lever 42 so as to pivot the lever 42 about the lock bar axis 34 in the counterclockwise direction. The lever 42 then rotates the lock bar 32 in the counterclockwise direction, which is toward the locked position. The linkage mechanism 36 thus applies the force of the coil spring 68 to the lock bar 32 to rotate the lock bar 32 toward the locked position when the linkage mechanism 36 is in the first over-center condition. Such rotation of the lock bar 32 is limited upon contact of the hub portion 60 of the sliding link 46 with an adjacent flat surface 72 of the cylinder body 12, as shown in FIG. 2.

Figure 3:
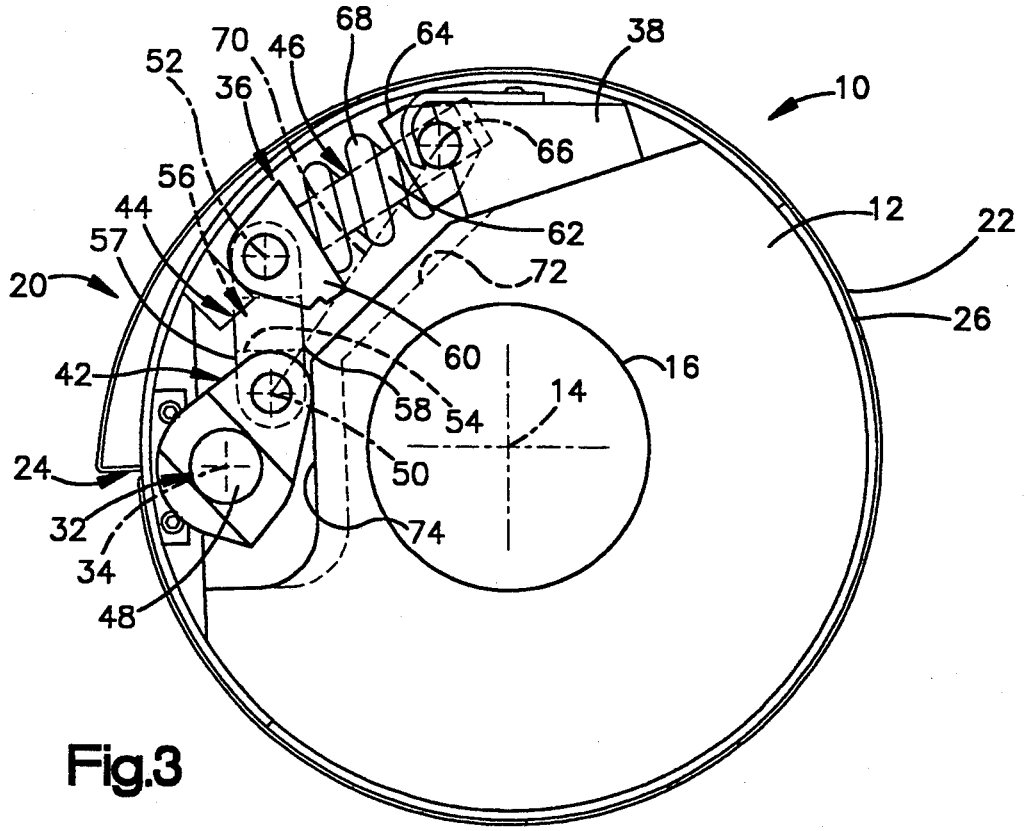
FIG. 3 is a view showing the parts of FIG. 2 in different positions.

When the linkage mechanism 36 is in the second over-center condition, as shown in FIG. 3, the second linkage axis 52 is located radially outward of the line 70 extending between the first linkage axis 50 and the third linkage axis 66. The sliding link 46 then forces the toggle link 44 to pivot about the second linkage axis 52 in the counterclockwise direction, and also to pivot about the first linkage axis 50 in the counterclockwise direction, under the force of the coil spring 68. The toggle link 44 in turn forces the lever 42 to pivot about the lock bar axis 34 in the clockwise direction. The lever 42 then rotates the lock bar 32 in the clockwise direction, which is toward the unlocked position. The linkage mechanism 36 thus applies the force of the coil spring to the lock bar 32 to rotate the lock bar 32 toward the unlocked position when the linkage mechanism 36 is in the second over-center condition. Such rotation of the lock bar 32 is limited upon contact of the lever 42 with an adjacent edge surface 74 of the cylinder body 12, as shown in FIG. 3.

Figure 4:
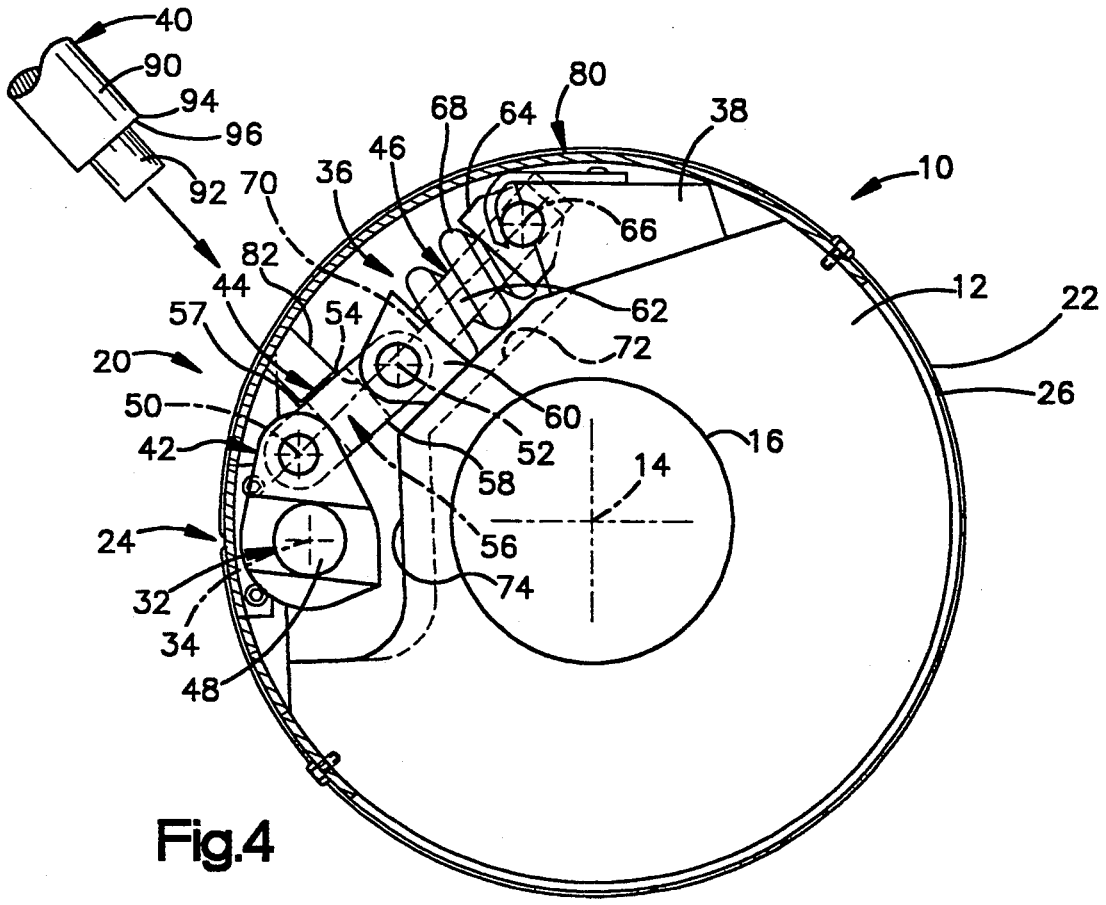
FIG. 4 is a view similar to FIG. 2 showing additional parts of the apparatus constructed in accordance with the present invention.
Figure 5:
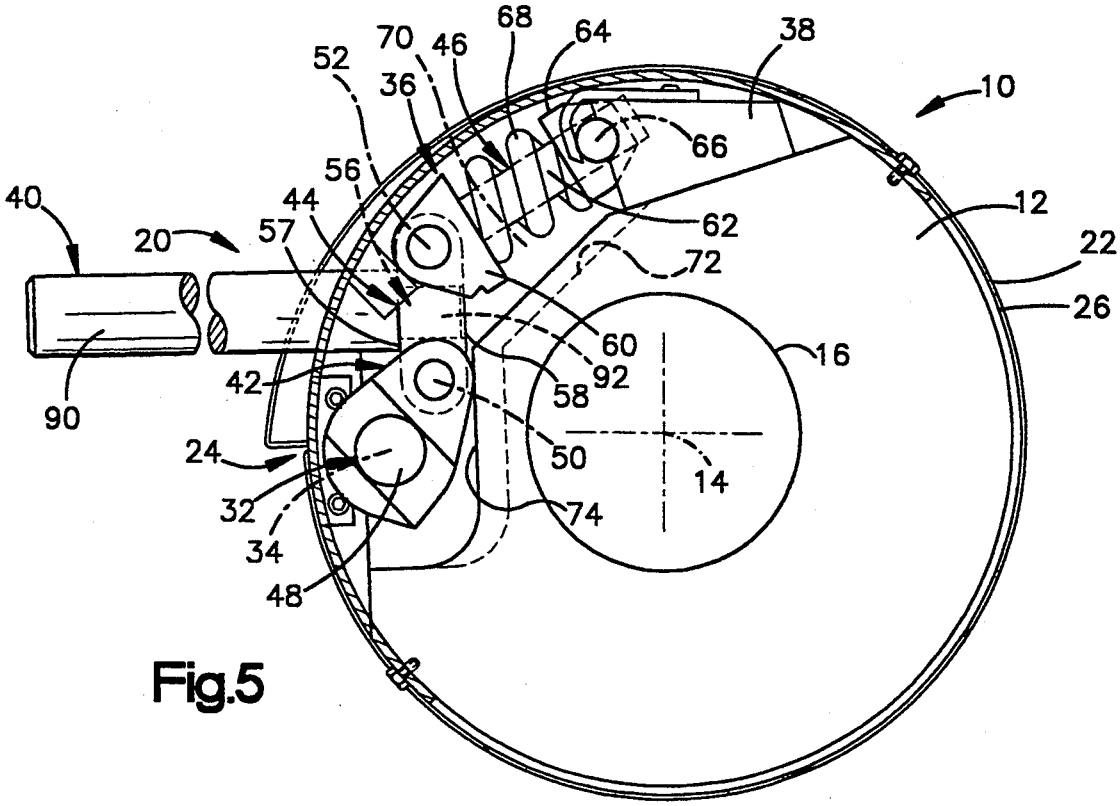
FIG. 5 is a view showing the parts of FIG. 4 in different positions.
Figure 6:
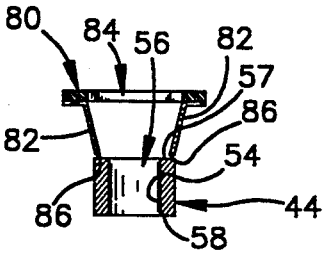
FIG. 6 is a partial axial sectional view of parts shown in FIG. 5.

As shown in FIGS. 4–6, a cover 80 is received on the end of the cylinder body 12. The cover 80 extends circumferentially and axially over the linkage mechanism 36, and supports a pair of spring tabs 82. As shown in FIG. 6, the spring tabs 82 extend radially inward from the cover 80 on axially opposite sides of a slot 84 which extends through the cover 80. The spring tabs 82 coverage axially, and each one has a radially inner end 86.

When the linkage mechanism 36 is in the first over-center condition and the lock bar 32 is in the locked position, the radially inner ends 86 of the spring tabs 82 are located closely adjacent to the radially outer side surface 57 of the toggle link 44, as shown in FIGS. 4 and 6. The spring tabs 82 are thus located in positions to block the toggle link 44 from moving radially outward under the influence of centrifugal force when the cylinder 10 is rotating about the axis 14 during a printing operation. Accordingly, the spring tabs 82 prevent the linkage mechanism 36 from switching from the first over-center condition to the second over-center condition, and thus prevent rotation of the lock bar 32 from the locked position to the unlocked position, under the influence of centrifugal force during a printing operation.

Figure 8:
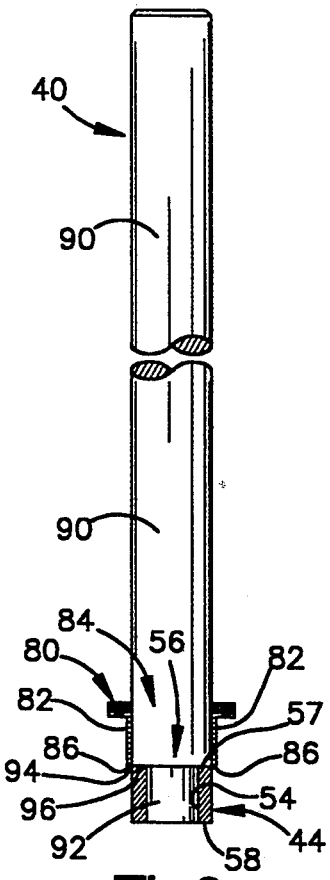
FIG. 8 is a view of the part of FIG. 7 in association with the parts of FIG. 6.

As noted above, the linkage mechanism 36 is operated manually by use of the tool 40. In the preferred embodiment of the present invention the tool 40 is a cylindrical rod with a major portion 90 and a reduced diameter end portion 92. The major portion 90 has a circular edge 94 and an annular end surface 96 surrounding the end portion 92. The tool 40 is thus designed to engage the toggle link 44 with the end portion 92 of the tool 40 received closely within the bore 56 in the toggle link 44, and with the annular end surface 96 of the tool 40 abutting the radially outer side surface 57 of the toggle link 44, as shown in FIG. 8.

An operator of the printing unit moves the tool 40 into engagement with the toggle link 44 by moving the tool 40 inwardly through the slot 84 in the cover 80 in a single direction indicated by the arrow shown in FIG. 4. When the tool 40 is thus moved into engagement with the toggle link 44, the circular edge 94 of the tool 40 moves against the spring tabs 82 and forces the spring tabs 82 to flex axially away from each other against the bias of the spring tabs 82. The spring tabs 82 are thus flexed from the converging positions of FIG. 6 to the parallel positions of FIG. 8. The radially inner ends 86 of the spring tabs 82 are then located axially outward of the toggle link 44. As a result, the spring tabs 82 no longer block the toggle link 44 from moving radially outward, but instead are spaced apart from each other sufficiently to permit the toggle link 44 to move radially outward between them. The operator of the printing unit can then switch the linkage mechanism 36 from the first over-center condition to the second over-center condition by moving the tool 40 manually into the position shown in FIG. 5. The operator can similarly switch the linkage mechanism 36 back from the second over-center condition to the first over-center condition by moving the tool 40 manually back from the position of FIG. 5. The spring tabs 82 flex resiliently back to the converging positions of FIG. 6 when the tool 40 is disengaged from the toggle link 44 and removed outwardly through the slot 84 in a direction opposite to the arrow shown in FIG. 4.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a cylinder body (12) with a cylindrical outer surface means (26) for receiving a printing plate (22) in overlying engagement;

a rotatable lock bar (32) means for engaging the printing plate (22) to secure the printing plate (22) on said cylinder body (12) upon rotation of said lock bar means (32) in a first direction, and to release the printing plate (22) for removal from said cylinder body (12) upon rotation of said lock bar means (32) in a second direction;

spring means (68) for providing a spring force for rotating said lock bar means (32);

linkage means (36) for rotating said lock bar means (32) under the influence of said spring force, said linkage means (36) having a first over-center condition in which said linkage means (36) rotates said lock bar means (32) in said first direction and having a second over-center condition in which said linkage means (36) rotates said lock bar means (32) in said second direction;

blocking means (82) for blocking said linkage means (36) from switching from said first over-center condition to said second over-center condition, said blocking means (82) including a movable blocking member (82) having a first position in which said blocking member (82) blocks such switching of said linkage means (36) and a second position in which said blocking member (82) does not block such switching of said linkage means (36); and a hand held tool (40) having means (92, 96) for engaging said linkage means (36) to switch said linkage means (36) between said first and second over-center conditions upon manual manipulation of said tool (40), said tool (40) further having means (94) for engaging said blocking member (82) to move said blocking member (82) from said first position to said second position upon manual manipulation of said tool (40).

2. Apparatus as defined in claim 1 wherein said cylinder body (12) has a longitudinal central axis of rotation (14), said linkage means (36) being subjected to a centrifugal force urging said linkage means (36) to switch from said first over-center condition to said second over-center condition upon rotation of said cylinder body (12) about said longitudinal central axis of rotation (14), said blocking member (82) blocking such switching of said linkage means (36) when said blocking member (82) is in said first position.

3. Apparatus as defined in claim 2 wherein said blocking member (82) is a spring member (82), said spring member (82) being movable from said first position to said second position against a bias of said spring member (82), said spring member (82) being movable back from said second position to said first position under the influence of said bias.

4. Apparatus as defined in claim 3 wherein said tool (40) is movable into an engaged position in which said tool (40) engages said linkage means (36) so as to switch said linkage means (36) from said first over-center condition to said second over-center condition, said tool (40) having means (94) for moving said spring member (82) from said first position to said second position upon movement of said tool (40) to said engaged position.

5. Apparatus as defined in claim 4 wherein said tool (40) is movable in a single direction from a disengaged position to said engaged position, said disengaged position being spaced radially outward from said cylindrical outer surface (26) of said cylinder body (12).

6. Apparatus as defined in claim 1 wherein said blocking means (82) comprises a pair of spring tabs (82), each of said spring tabs (82) having a first position blocking said linkage means (36) from switching to said second over-center condition and a second position not blocking said linkage means (36) from switching to said second over-center condition, said tool (40) having means (94) for moving said spring tabs (82) from said first positions to said second positions against the bias of said spring tabs (82).

7. Apparatus as defined in claim 6 wherein said spring tabs (82) converge when in said first positions, said tool (40) being movable between and against said spring tabs (82) to force said spring tabs (82) to move away from each other toward said second positions.

8. Apparatus as defined in claim 7 wherein said linkage means (36) includes a movable link member (44) which is blocked by said spring tabs (82) when said spring tabs (82) are in said first positions, said link member (44) being movable between said spring tabs (82) upon switching of said linkage means (36) to said second over-center condition when said spring tabs (82) are in said second positions.

9. Apparatus as defined in claim 8 wherein said tool (40) is movable into an engaged position in which said tool (40) engages said link member (44) so as to move said link member (44) between said spring tabs (82) and thereby to switch said linkage means (36) to said second over-center condition, said tool (40) being movable between and against said spring tabs (82) upon movement of said tool (40) to said engaged position.

10. Apparatus as defined in claim 1 wherein said tool (40) is movable into an engaged position in which said tool (40) engages said linkage means (36) so as to switch said linkage means (36) from said first over-center condition to said second over-center condition, said tool (40) having means (94) for moving said blocking member (82) from said first position to said second position upon movement of said tool (40) to said engaged position.

11. Apparatus as defined in claim 10 wherein said tool (40) is movable in a single direction from a disengaged position to said engaged position, said disengaged position being spaced radially outward from said cylindrical outer surface (26) of said cylinder body (12).

12. Apparatus as defined in claim 10 wherein said blocking member (82) is a spring member (82), said spring member (82) being movable from said first position to said second position against a bias of said spring member (82), said spring member (82) being movable back from said second position to said first position under the influence of said bias.

* * * * *